United States Patent [19]

Gorney

[11] Patent Number: 4,760,959

[45] Date of Patent: Aug. 2, 1988

[54] DRIVE ARM DEFLECTOR FOR A ROTARY IMPACT SPRINKLER

[75] Inventor: Moshe Gorney, Kibbutz Naan, Israel

[73] Assignee: Naan Mechanical Works, Kibbutz Naan, Israel

[21] Appl. No.: 894,332

[22] Filed: Aug. 8, 1986

[30] Foreign Application Priority Data

Aug. 11, 1985 [IL] Israel ..... 76072

[51] Int. Cl.[4] ..... B05B 3/08

[52] U.S. Cl. ..... 239/233; 239/501; 239/516

[58] Field of Search ..... 239/230, 233, 237, 499, 239/501, 504, 516, 519, 523, 231

[56] References Cited

U.S. PATENT DOCUMENTS 3,022,012 2/1962 Sharp et al. .
3,955,762 5/1976 Cassimatis et al. .
4,164,324 8/1979 Bruninga ..... 239/233
4,182,494 1/1980 Wichman ..... 239/233
4,402,460 9/1983 Shavit et al. .
4,514,291 4/1985 McGarry ..... 239/501

*Primary Examiner*—Peter A. Aschenbrenner
*Assistant Examiner*—Gerald A. Anderson
*Attorney, Agent, or Firm*—Weingarten, Schurgin, Gagnebin & Hayes

[57] ABSTRACT

In an impact drive sprinkler including a rotatable body arranged to rotate about a rotation axis and having a sprinkler nozzle through which water is ejected in an outward direction from the rotation axis, a deflector defining a spiral water engagement surface which extends approximately 360 degrees from an inlet location intermittently adjacent the sprinkler nozzle to an outlet location, the inlet location being azimuthally displaced therefrom about said rotation axis.

18 Claims, 6 Drawing Sheets

DRIVE ARM DEFLECTOR FOR A ROTARY IMPACT SPRINKLER

FIELD OF THE INVENTION

The present invention relates to rotary sprinklers of the impact type and more particularly to a deflector arm for such sprinklers having low side splash characteristics.

BACKGROUND OF THE INVENTION

Rotary sprinklers of the impact type are well known in the art and in the patent literature. An exemplary sprinkler of this type is described and claimed in U.S. Pat. No. 4,402,460, which is assigned to the assignee of the present application.

A rotatable sprinkler having a deflector which is designed to minimize backsplash is described and claimed in U.S. Pat. No. 3,022,012 which discloses a Z or S shape deflector.

Another rotatable sprinkler having a deflector which is designed to minimize backsplash is described and claimed in U.S. Pat. No. 3,955,762 to Cassimatis et al. According to the teaching of this patent, the deflector includes three water deflecting surfaces which receive and redirect water from the jet in a smooth, substantially turbulent free manner. The water is first redirected along a first straight path at least approximately 90 degrees from the axis of the jet. It is then redirected along a second path at an acute angle with and in front of the first path and thereafter it is redirected along a third path which is approximately parallel with the axis of the issuing jet.

Another type of anti-side splash deflector is described and claimed in U.S. Pat. No. 4,182,494 to Wichman et al. According to the teaching of this patent, the deflector comprises a reaction member which includes a first curved portion for deflecting a stream of water ejected from a nozzle on the sprinkler through a first obtuse angle, and a second curved portion, spaced laterally from and behind the first curved portion, for deflecting the stream of water through a second obtuse angle approximately equal to the first whereby the deflected water stream emerges substantially parallel to the stream of water ejected from the nozzle, the second angle being reversed with respect to the first obtuse angle and each being of at least about 120 degrees.

All of the above prior art sprinklers deflect the water stream as it comes out of the nozzle in the plane of rotation of the sprinkler head. Thus proper alignment of the deflector and complete seating of the deflector in its extreme rotation position at which the deflector lies in front of the nozzle is required to attain the desired deflection.

SUMMARY OF THE INVENTION

The present invention seeks to provide a highly efficient deflector for a rotary impact sprinkler.

There is thus provided in accordance with a preferred embodiment of the present invention in an impact drive sprinkler including a rotatable body arranged to rotate about a rotation axis and having a sprinkler nozzle through which water is ejected in an outward direction from the rotation axis, a deflector defining a spiral water engagement surface which extends approximately 360 degrees from an inlet location intermittently adjacent the sprinkler nozzle to an outlet location, the inlet location being azimuthally displaced therefrom about said rotation axis.

For the purpose of the specification and claims herein, the reference to "approximately 360 degrees" is defined to mean 360 degrees plus or minus a desired tilt adjustment of up to 35 degrees. Furthermore the term "spiral" is defined to include curves having a fixed center as well as similar curves not having a fixed center.

There is also provided in accordance with a preferred embodiment of the present invention in an impact drive sprinkler including a rotatable body arranged to rotate about a rotation axis and having a sprinkler nozzle through which water is ejected in an outward direction from the rotation axis, a deflector defining a curved water engagement surface which extends from an inlet location intermittently adjacent the sprinkler nozzle to an outlet location, said deflector being arranged such that said water engagement surface includes a first engagement surface portion which deflects water ejected from the nozzle in a first direction generally perpendicular to the plane of rotation of the deflector and a second engagement surface porton which deflects water received from the first engagement surface portion in a second direction which is generally parallel to the stream of pressurized water from the nozzle.

Further in accordance with an embodiment of the present invention, the water engagement surface engages the water ejected from the nozzle generally along the entire 360 degree extent thereof.

Additionally in accordance with an embodiment of the invention, the water engagement surface provides good control of the water stream such that the stream can remain in contact therewith along generally the entire extent of the water engagement surface.

Further in accordance with an embodiment of the present invention, the water flow from the outlet location is generally parallel to the water flow from the nozzle for a given rotational position of the deflector relative to the nozzle.

Additionally in accordance with an embodiment of the present invention, the water engagement surface is arranged to define rotation of approximately 360 degrees in a vertical plane.

Further in accordance with an embodiment of the invention, the water engagement surface is integrally formed with the sprinkler deflector arm.

Additionally in accordance with a preferred embodiment of the present invention, there is provided a rotary impact sprinkler comprising a body rotatable about a rotation axis and defining a nozzle arranged to provide a stream of pressurized water or other liquid, spring loaded stream deflector and hammer apparatus for intermittently engaging the stream and providing in response to said engagement a force causing intermittent rotation of the body about the rotation axis and including a deflector defining a spiral water engagement surface which extends approximately 360 degrees from an inlet location adjacent the sprinkler nozzle to an outlet location azimuthally displaced therefrom about said rotation axis.

Further in accordance with a preferred embodiment of the present invention, there is provided a rotary impact sprinkler comprising a body rotatable about a rotation axis and defining a nozzle arranged to provide a stream of pressurized water or other liquid, spring loaded stream deflector and hammer apparatus for intermittently engaging the stream and providing in response to said engagement a force causing intermittent rotation of the body about the rotation axis and including a deflector defining a curved water engagement surface which extends from an inlet location intermittently adjacent the sprinkler nozzle to an outlet location, said deflector being arranged such that said water engagement surface includes a first engagement surface portion which deflects water ejected from the nozzle in a first direction generally perpendicular to the plane of rotation of the deflector and a second engagement surface portion which deflects water received from the first engagement surface portion in a second direction which is generally parallel to the stream of pressurized water from the nozzle.

Additionally in accordance with an embodiment of the invention, the azimuthal separation between inlet and outlet streams to and from the deflector respectively can be selected as can the precise angular separation between the streams in the plane perpendicular to the plane of rotation of the deflector.

According to an alternative embodiment of the invention, the azimuthal and angular separations may be adjustable.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1:
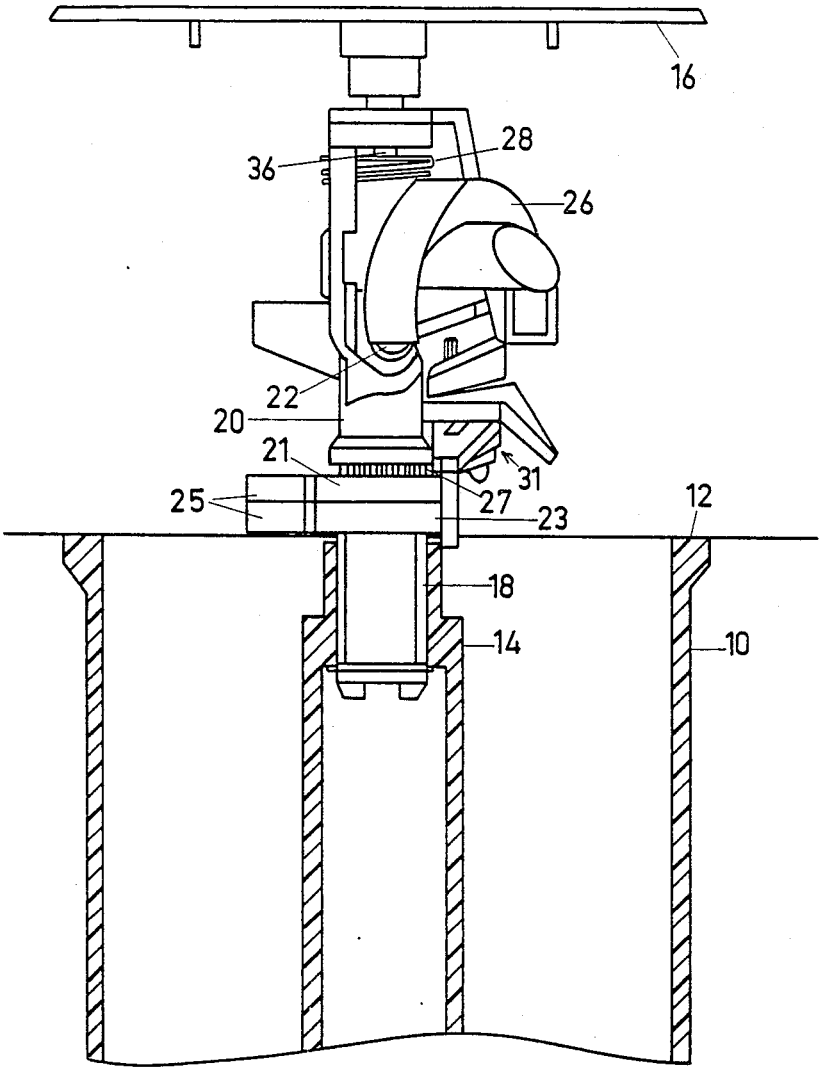
FIGS. 1 and 2 are respective front and side view pictorial illustrations of a rotary sprinkler constructed and operative in accordance with a preferred embodiment of the present invention.
Figure 2:
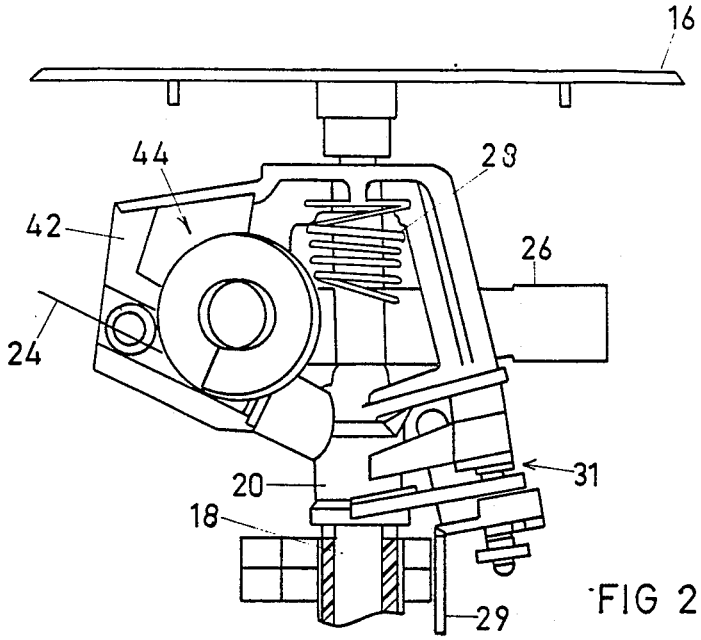

Reference is now made to FIGS. 1 and 2, which illustrate a rotary sprinkler constructed and operative in accordance with a preferred embodiment of the present invention. The rotary sprinkler is illustrated in the context of a pop-up sprinkler having a housing 10, which is disposed normally below the ground surface such that its upper rim 12 lies flush with the ground surface, a water supply stem 14 which is connected to a source of pressurized water, and a cover member 16 which is attached to the rotary sprinkler and protects it when the sprinkler is retracted within housing 10.

It will be appreciated that the sprinkler of the present invention need not be employed as a pop-up sprinkler and that the present invention is not necessarily limited to pop-up sprinklers.

The sprinkler includes a mounting and water coupling shaft 18 which is rotatably mounted and sealingly seated onto water supply stem 14. Mounted onto shaft 18 is a body 20, which defines a nozzle outlet 22 for provision of a pressurized stream of liquid which is directed generally along a nozzle outlet axis 24. Alternatively, body 20 and shaft 18 may be integrally formed. A combination water stream deflector and hammer element 26 is rotatably mounted onto body 20 and is spring coupled thereto by a spring 28.

Generally speaking, the action of the deflector and hammer element 26 is to intermittently engage the pressurized stream of liquid for deflection thereof. This causes the deflector to move out of engagement with the stream momentarily, storing potential energy in spring 28. Spring 28 then exerts a return force which causes element 26 to impact against the body, causing its rotation in intermittent steps occuring between about 100–800 times per minute. What has been described so far is forward motion of the sprinkler and it normally occurs in a clockwise direction when viewed from the top of the sprinkler.

The sprinkler illustrated in FIGS. 1 and 2 is constructed to provide operation in selectable azimuthal zones. The zones of operation are defined typically by a pair of concentric rings 21 and 23, each formed with a protruding finger portion 25. Rings 21 and 23 are formed with toothed inner peripheral surfaces which selectably engage toothed surfaces 27 formed on the shaft 18, so that rings 21 and 23 can be located as desired and retain their location until it is changed by a user.

The sprinkler of FIGS. 1 and 2 is arranged for forward and backward motion. It is shifted from forward to backward motion by operation of an engagement finger 29 which operates a direction shifting mechanism 31 which is operative by selectably limiting the range of rotation of the deflector in the azimuthal plane. The structure and operation of a preferred embodiment of azimuthal zone selection apparatus of the type illustrated in FIGS. 1 and 2 is described in detail in U.S. Pat. No. 4,402,460 entitled Rotary Sprinkler, issued Sept. 6, 1983 and assigned to the assignee of the present invention. The relevant disclosure in that patent is incorporated herein by reference.

Figure 6A:
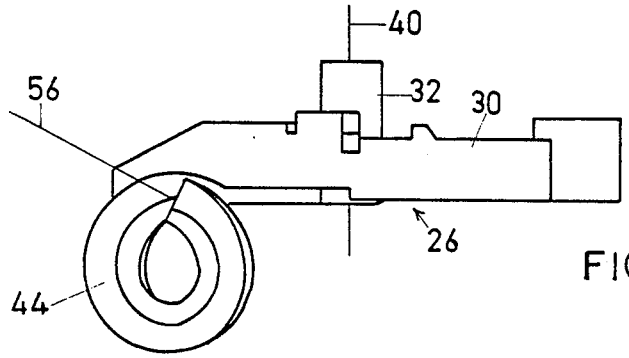
FIGS. 6A and 6B are respective side view and top view illustrations of an embodiment of a deflector useful in accordance with an embodiment of the present invention.
Figure 6B:
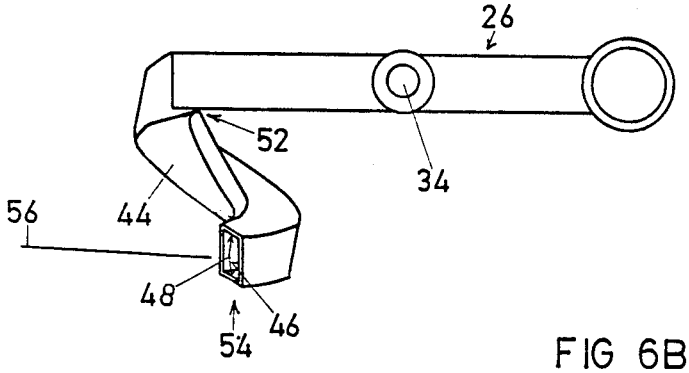

The present invention is concerned particularly with the structure and operation of the deflector and hammer element 26. This element is illustrated in FIGS. 6A and 6B. It is seen that the deflector and hammer element comprises a generally elongate arm 30, typically perpendicular to which is located a sleeve 32 which defines an elongate bore 34 which is rotatably mounted on a rod 36 which is fixedly mounted onto body 20 and extends upwardly therefrom. Rod 36 defines an axis of rotation 40 for the deflector and hammer element which is coaxial with the axis of rotation of the sprinkler with respect to stem 14.

An impact member 42 which is fixedly attached to body 20 is engaged by deflector and hammer element 26 when it swings back under the action of spring 28, thus causing the desired stepwise rotation of the body 20 about stem 14 and producing a rotational sprinkler pattern.

According to a preferred embodiment of the invention, the deflector and hammer element 26 comprises a sprial water deflection pathway 44 which includes a spiral water engagement surface 46 and side surfaces 48.

The spiral water deflection pathway 44 defines a water inlet 52 for receipt of the nozzle outlet stream along nozzle outlet axis 24 and a water outlet 54 which may be oriented to produce a water outlet stream which extends along a deflector outlet axis 56 which is normally parallel to nozzle outlet axis 24. Alternatively deflector outlet axis 56 may be angled with respect to nozzle outlet axis 24 in the azimuthal plane with respect to axis 40, or it may be angled with respect to nozzle outlet axis 24 in a plane parallel to axis 40. As a further alternative, it may angled with respect to the nozzle outlet axis 24 in both planes.

It is a particular feature of the present invention that deflection of the water is produced over approximately 360 degrees from the inlet to the outlet. The approximately 360 degrees deflection may take place in a plane parallel to axis 40, as illustrated in the embodiments of FIGS. 1 and 2. Alternatively it may take place in the azimuthal plane, although this is not preferred. As a further alternative, the approximately 360 degree deflection may take place in any other desired plane.

It is seen clearly in FIG. 1 that irrespective of the angular separation, if any, between axes 24 and 56, the inlet and outlet are displaced from each other, since they cannot occupy the same place. The amount of this displacement may be selected in accordance with design considerations.

Figure 5:
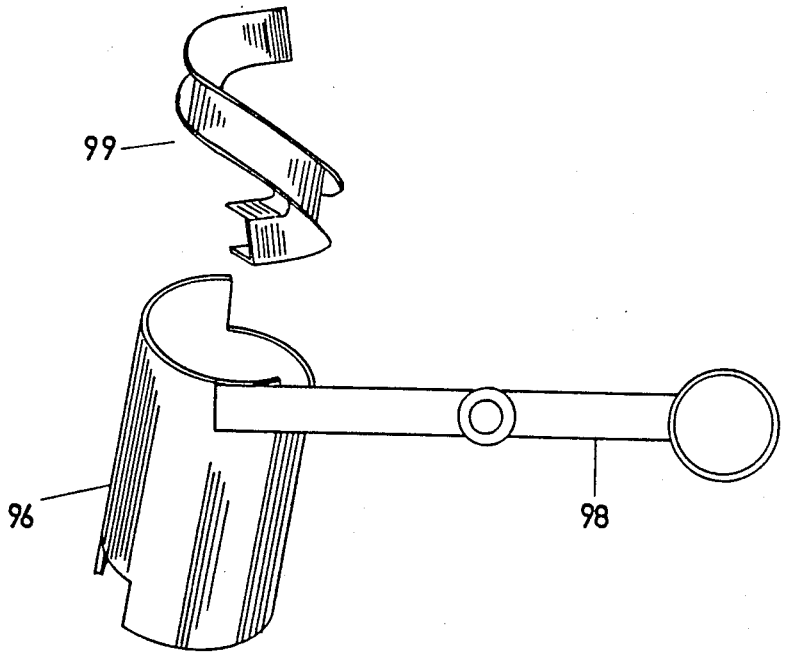
FIGS. 3, 4 and 5 are respective exploded views of two alternative embodiments of deflectors.
Figure 3:
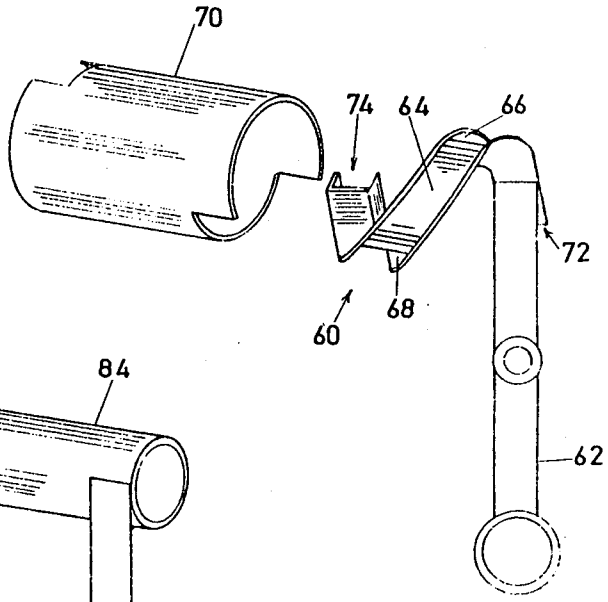
Figure 4:
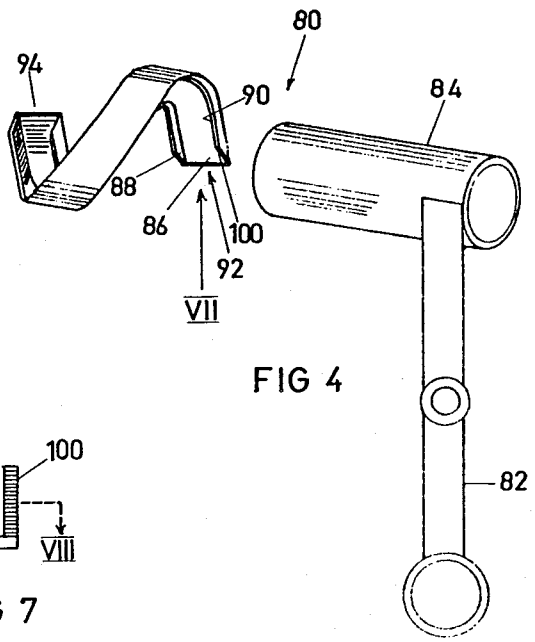

Reference is now made to FIGS. 3, 4 and 5 which illustrate in exploded view form, three alternative general techniques for forming a spiral water engagement surface containing deflector. In the embodiment of FIG. 3, a deflector 60 is integrally formed, as by molding of plastic or metal, with an arm 62 having attached thereto an outwardly facing spiral surface 64 bounded by edge surfaces 66 and 68 respectively. A cylindrical sleeve 70, which is normally molded separately, is slipped over the spiral surface thus defined to define a spiral water engagement pathway having an inlet 72 and an outlet 74.

In the alternative embodiment of FIG. 4, a deflector 80 is formed with integrally formed arm and cylindrical sleeve 82 and 84 respectively. An inwardly facing spiral water engagement surface 86 bounded by edge surfaces 88 and 90 is normally moulded separately and may be made of a material different from that of the remainder of the deflector, as is the case with cylindrical sleeve 70, as well. The spiral water engagement surface 86 is fitted over cylindrical sleeve 84 to define a spiral water engagement pathway having an inlet 92 and an outlet 94.

It is possible to eliminate the inner cylinder (such as sleeve 84 in FIG. 4) in the case where the water stream maintains contact generally along the outer cylinder and side cylindrical surface of the spiral pathway. By doing this two molding problems can be solved; (a) a more rigid mold can be used to produce the deflector and (b) the deflector can be produced in two parts without a parting line on the inner surface of the spiral, followed by assembly of the full spiral from these two parts. In any case one of the two parts may be made integrally with the hammer.

FIG. 5 illustrates yet another embodiment of the invention wherein an outer sleeve 96 is formed integrally with the arm 98 and the remainder of the pathway 99 is separately molded and subsequently joined thereto.

It should be noted that inner pathway 99 can be replaced by a screw thread mounted on a central shank (not illustrated).

Figure 7:
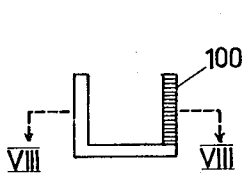
FIG. 7 is an enlarged illustration of the water inlet to the water engagement pathway in a direction indicated by an arrow VII on FIG. 4.
Figure 8:
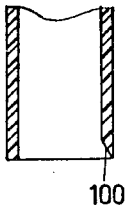
FIG. 8 is a sectional illustration taken along the lines VIII—VIII of FIG. 7.

The configuration of the inlet 92 of the spiral water engagement pathway is illustrated in FIGS. 7 and 8, where it is seen that the forward edge 100 of surface 90 is preferably sharp.

Figure 9:
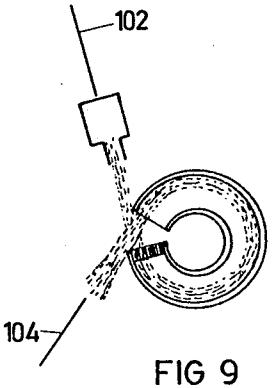
FIG. 9 is a schematic diagram illustrating the flow of water through a deflector of the type illustrated in any of FIGS. 1–8.
Figure 10B:
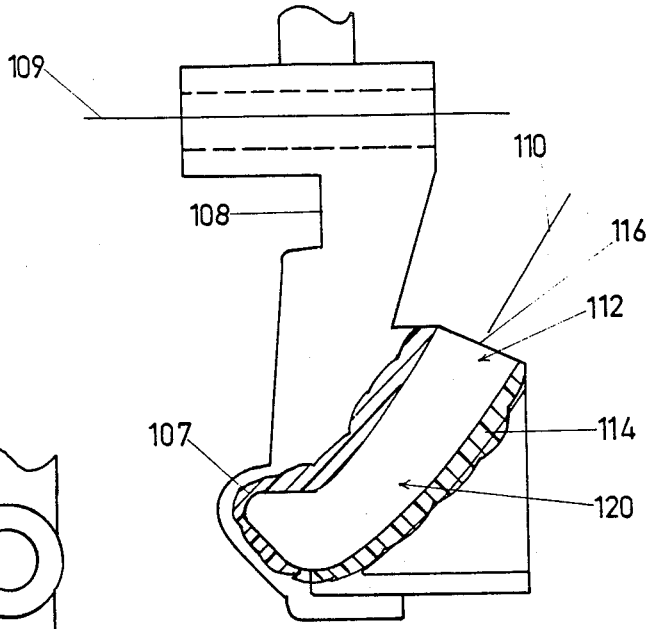
FIGS. 10A–10I are illustrations of an alternative embodiment of a deflector constructed and operative in accordance with an embodiment of the present invention.
Figure 10A:
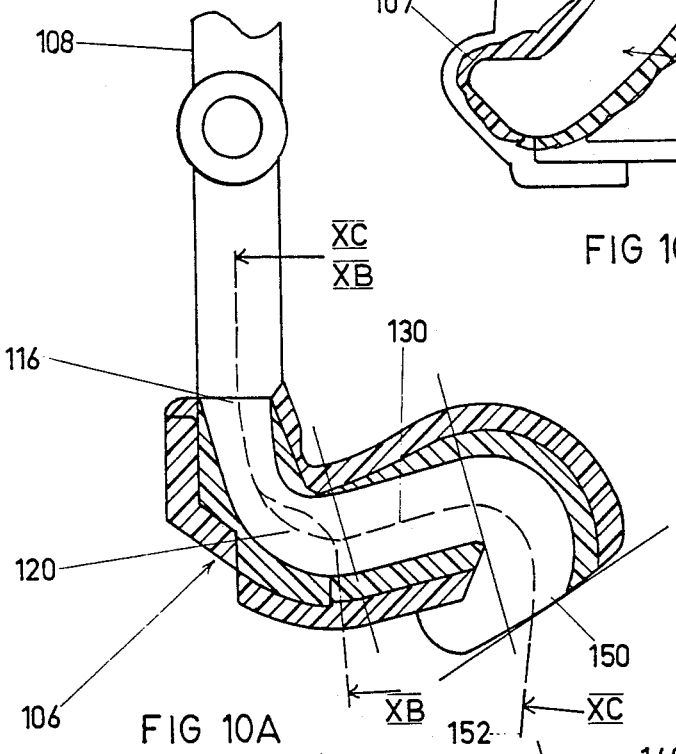
Figure 10C:
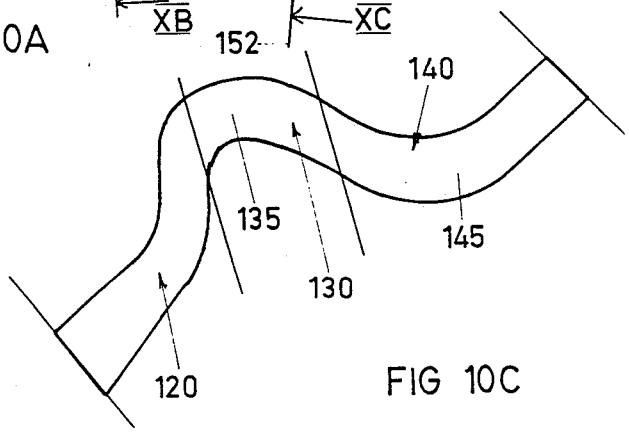
Figure 10D:
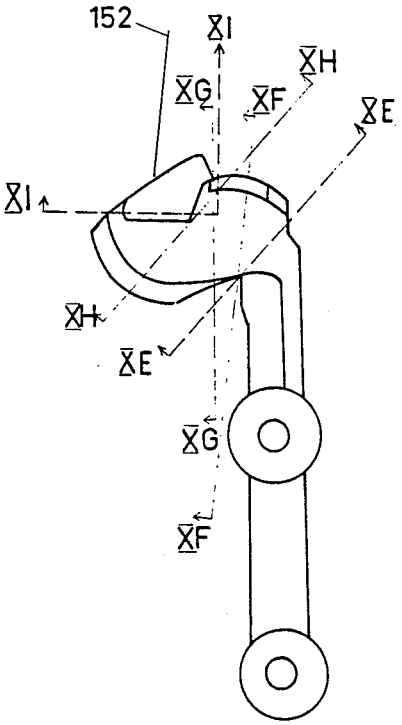
Figure 10E:
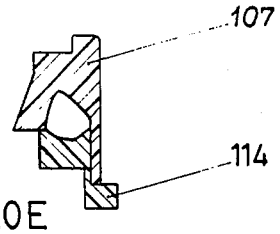
Figure 10F:
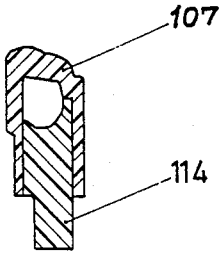
Figure 10G:
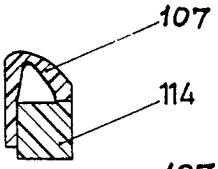
Figure 10H:
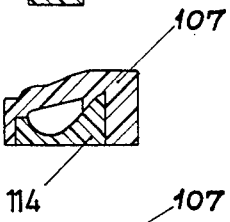
Figure 10I:
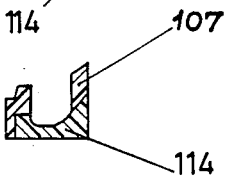

FIG. 9 illustrates in a general way, the fact that in accordance with a preferred embodiment of the present invention, the water stream passing along the the water engagement pathway maintains contact therewith generally along the entire length of the pathway. For the purposes of clarity of illustration, FIG. 9 is drawn showing the axes of flow into and out of the pathway, (respectively indicated by reference numerals 102 and 104) as not parallel, which is not normally preferred.

Reference is now made to FIGS. 10A–10I which illustrate an alternative embodiment of deflector 106. A part 107 of the deflector is preferably integrally formed with a hammer arm 108 which is arranged for rotation in a rotation plane about a rotation axis 109. Water exiting a nozzle (not shown) along an axis 110 enters a water engagement pathway 112 which is defined jointly by part 107 and by a second member 114 which cooperates with part 107 and is fixed thereto. The location of the inlet to the water engagement pathway is indicated by reference numeral 116.

The water engagement pathway extends upwardly with respect to the rotation plane and simultaneously sideways in a counterclockwise direction in a region indicated generally by reference numeral 120. Downstream of region 120 in a region indicated generally by reference numeral 130, the pathway continues to extend upward and sideways in generally the same direction as at the downstream end of region 120 until about a location indicated by reference numeral 135. Downstream of this location, the pathway extends downwardly.

Downstream of region 130, in a region indicated generally by reference numeral 140 the pathway continues to extend downwardly and move sideways in a clockwise direction to a location indicated generally by reference numeral 145. Downstream of location 145, the pathway continues its sideways motion and begins to extend upwardly to the oulet 150. The water exits at the outlet 150 along an exit axis 152 which extends upwardly with respect to the rotation plane and is generally in the same direction in the plane parallel to axis 109 as axis 110. In the plane of rotation, the axis 152 is directed towards axis 110 such that the streams extending therealong would tend towards intersection. Alternatively, the orientation of axis 152 need not be as described hereinabove.

It will be appreciated by persons skilled in the art that the present invention is not limited to what has been specifically shown and described hereinabove. Rather the scope of the present invention is defined only by the claims which follow:

I claim:

1. In an impact drive sprinkler including a rotatable body arranged to rotate about a rotation axis and having a sprinkler nozzle through which water is ejected in an outward direction from said rotation axis, a deflector defining a spiral water engagement surface which extends approximately 360 degrees from an inlet location adjacent the sprinkler nozzle to an outlet location azimuthally displaced therefrom about said rotation axis.

2. Apparatus according to claim 1 and wherein said water engagement surface engages the water ejected from the nozzle generally along the entire 360 degree extent thereof.

3. Apparatus according to claim 1 and wherein said water engagement surface directs the water stream to flow in contact with spiral water engagement surface along generally the entire extent thereof.

4. Apparatus according to claim 1 and wherein the water flow from the outlet location is generally parallel to the water flow from the nozzle for a given rotational position of the deflector relative to the nozzle.

5. Apparatus according to claim 1 and wherein said water engagement surface is arranged to define rotation of approximately 360 degrees in a vertical plane.

6. Apparatus according to claim 1 and wherein said water engagement surface is integrally formed with the sprinkler hammer arm.

7. Apparatus according to claim 1 and wherein the deflector outlet location is located adjacent the deflector inlet location.

8. Apparatus according to claim 1 and wherein said deflector is configured to define azimuthal and angular separations, at least one of which is adjustable, between said outward direction along which water is ejected from said sprinkler nozzle and a direction in which water is ejected from said spiral water engagement surface.

9. In an impact drive sprinkler including a rotatable body arranged to rotate about a rotation axis and having a sprinkler nozzle through which water is ejected in an outward direction from said rotation axis, a deflector defining a curved water engagement surface which extends from an inlet location adjacent the sprinkler nozzle to an outlet location, said deflector being arranged such that said water engagement surface includes a first engagement surface portion which deflects water ejected from the nozzle in a first direction generally perpendicular to the plane of rotation of the body and a second engagement surface portion which deflects water received from the first engagement surface portion in a second direction which is generally parallel to the stream of pressurized water ejected from the nozzle.

10. Apparatus according to claim 9 and wherein said water engagement surface directs the water stream to flow in contact with said spiral water engagement surface along generally the entire extent thereof.

11. Apparatus according to claim 9 and wherein said water engagement surface engages the water ejected from the nozzle generally along the entire 360 degree extent thereof.

12. Apparatus according to claim 9 and wherein said deflector is configured to define azimuthal and angular separations, at least one of which is adjustable, between said outward direction along which water is ejected from said sprinkler nozzle and a direction in which water is ejected from said spiral water engagement surface.

13. Apparatus according to claim 9 and wherein said water engagement surface comprises:

a first region receiving water exiting from said nozzle along a first axis and which extends upwardly with respect to a rotation plane perpendicularly to said rotation axis and simultaneously azimuthally in a first direction relative to said rotation axis; and a second region, downstream of said first region and which extends first upwardly and azimuthally in said first direction relative to said rotation axis in generally the same direction as at the end of the first region and thereafter downwardly and azimuthally.

14. Apparatus to claim 13 and wherein said water engagement surface also comprises:

a third region downstream of said second region which extends downwardly and sideways in a clockwise direction and thereafter sideways and upwardly to said outlet location.

15. Apparatus according to claim 14 and wherein said water engagement surface is configured such that the water exits at the outlet location along an exit axis which extends upwardly with respect to said rotation plane and generally in the same direction in a plane parallel to said rotation axis as said first axis.

16. A rotary impact sprinkler comprising:

a body rotatable about a rotation axis and defining a nozzle arranged to provide a stream of pressurized water or other liquid;

spring loaded stream deflector means and hammer means for intermittently engaging the stream and providing in response to said engagement a force causing intermittent rotation of the body about said rotation axis and said deflector means defining a spiral water engagement surface which extends approximately 360 degrees from an inlet location adjacent the sprinkler nozzle to an outlet location azimuthally displaced therefrom about said rotation axis.

17. A rotary impact sprinkler comprising:

a body rotatable about a rotation axis and defining a nozzle arranged to provide a stream of pressurized water or other liquid;

spring loaded stream deflector means and hammer means for intermittently engaging the stream and providing in response to said engagement a force causing intermittent rotation of the body about the rotation axis and including a deflector defining a curved water engagement surface which extends from an inlet location intermittently adjacent the sprinkler nozzle to an outlet location, said deflector being arranged such that said water engagement surface includes a first engagement surface portion which deflects water ejected from the nozzle in a first direction generally perpendicular to the plane of rotation of the deflector and a second engagement surface portion which deflects water received from the first engagement surface portion in a second direction which is generally parallel to the stream of pressurized water from the nozzle.

18. Apparatus according to claim 17 and wherein said water engagement surface comprises:

a first region receiving water exiting from said nozzle along a first axis and which extends upwardly with respect to a rotation plane perpendicularly to said rotation axis and simultaneously azimuthally in a first direction relative to said rotation axis; and a second region, downstream of said first region and which extends first upwardly and azimuthally in said first direction relative to said rotation axis in generally the same direction as at the end of the first region and thereafter downwardly and azimuthally.

* * * * *

UNITED STATES PATENT AND TRADEMARK OFFICE

CERTIFICATE OF CORRECTION

PATENT NO. : 4,760,959

DATED : August 2, 1988

INVENTOR(S) : Moshe Gorney

It is certified that error appears in the above-identified patent and that said Letters Patent is hereby corrected as shown below:

Column 2, line 23, "porton" should read --portion--

Column 6, line 29, "upward" should read --upwardly--

Column 8, line 3, "Apparatus to" should read --Apparatus according to--

Column 8, line 38, "and including a deflector defining" should read --and said deflector means defining--

Column 8, line 46, "deflector" should read --body--

Signed and Sealed this

Twenty-ninth Day of August, 1989

*Attest:*

DONALD J. QUIGG

*Attesting Officer*

*Commissioner of Patents and Trademarks*